US006895721B2

(12) United States Patent
Watanabe et al.

(10) Patent No.: US 6,895,721 B2
(45) Date of Patent: May 24, 2005

(54) FIXTURE FOR BUILDING BOARDS, A BUILDING BOARD HAVING THE FIXTURE FIXED THERETO, AND THE METHOD OF FASTENING THE BUILDING BOARDS

(75) Inventors: Morimichi Watanabe, Aichi (JP); Hiroshi Ito, Aichi (JP)

(73) Assignee: Nichiha Corporation, Aichi (JP)

( * ) Notice: Subject to any disclaimer, the term of this patent is extended or adjusted under 35 U.S.C. 154(b) by 477 days.

(21) Appl. No.: 09/776,204

(22) Filed: Feb. 2, 2001

(65) Prior Publication Data

US 2001/0011443 A1 Aug. 9, 2001

(30) Foreign Application Priority Data

Feb. 3, 2000 (JP) ..... 2000-026749
Feb. 22, 2000 (JP) ..... 2000-044820

(51) Int. Cl.[7] ..... E04B 2/32

(52) U.S. Cl. ..... 52/506.05; 52/476; 52/483.1; 52/506.06; 52/511; 52/513

(58) Field of Search ..... 52/506.01, 506.05, 52/506.06, 506.08, 543, 775, 546, 511, 513, 235, 509, 745.12, 731.5, 544, 551, 553, 512, 506.09, 506.1

(56) References Cited

U.S. PATENT DOCUMENTS

| | | | | | |
|---|---|---|---|---|---|
| 3,621,635 | A | * | 11/1971 | De Lange | |
| 5,265,396 | A | * | 11/1993 | Amimoto | 52/745.12 |
| 5,301,484 | A | * | 4/1994 | Jansson | 52/235 |
| 5,544,461 | A | * | 8/1996 | Sommerstein | 52/235 |
| 5,634,305 | A | * | 6/1997 | Erlanger | 52/235 |
| 6,055,787 | A | * | 5/2000 | Gerhaher | 52/546 |
| 6,098,364 | A | * | 8/2000 | Liu | 52/506.08 |
| 6,289,646 | B1 | * | 9/2001 | Watanabe | 52/506.01 |
| 6,460,311 | B1 | * | 10/2002 | Ito | 52/731.9 |
| 6,491,172 | B2 | * | 12/2002 | Chance et al. | 211/87.01 |

FOREIGN PATENT DOCUMENTS

| | | | | |
|---|---|---|---|---|
| CA | 2290080 | | 7/2000 | |
| EP | 0008272 | * | 2/1980 | |
| JP | 63-96140 | | 6/1988 | E04F/13/08 |
| JP | 4-14631 | | 2/1992 | E04F/13/14 |

OTHER PUBLICATIONS

Canadian Office Action dated Jan. 22, 2003, 2 pages.
Partial Translation of Japanese Utility Model Publication No. H4–14631, one page.
Partial Translation of Japanese Utility Model Publication No. 63–96140, one page.
Partial Translation of Office Action relating to Japanese Application No. 2000–044820 dated Aug. 14, 2002, one page.
Office Action relating to Japanese Application No. 2000–044820, two pages.

* cited by examiner

*Primary Examiner*—Carl D. Friedman
*Assistant Examiner*—Yvonne M. Horton
(74) *Attorney, Agent, or Firm*—Osha • Liang LLP

(57) ABSTRACT

A plurality of engaging pieces each formed of washer (35) for instance are fixed to the rear surface of a building board (30). A plurality of elongated fixtures (10), each provided at the lower end thereof with an engaging tongue (20*a*) and at the upper end thereof with an engaging region (12*a*) designed to be engaged with the engaging tongue (20*a*), are engaged with the engaging pieces. The fixtures (10) thus engaged are directly fixed to the posts (1) or studs (2) of a building. Since each fixture (10) is provided with a rising portion (12), a ventilation space (Sc) is secured between the framework of the building and the rear surface of a building board (30). The coupling between upper and lower building boards (30) can be effected through the linkage between a couple of fixtures (10). Since the engaging tongue (20*a*) is made separable from the building board (30), the building boards (30) can be transported for instance without becoming bulky.

7 Claims, 17 Drawing Sheets

FIXTURE FOR BUILDING BOARDS, A BUILDING BOARD HAVING THE FIXTURE FIXED THERETO, AND THE METHOD OF FASTENING THE BUILDING BOARDS

BACKGROUND OF THE INVENTION

1. Field of the Invention

The present invention relates to a method of fastening flat building boards such as ceramic siding boards to the framework of a building, and to a building board as well as a fixture, which are suited for use in the fastening method.

2. Description of the Related Arts

In an exterior finish work of a building, ceramic siding boards (building boards) are employed for attaching them to the sidewall of a building. For example, in a horizontal board siding work where the building boards are attached to the frame construction with the longitudinal direction of the building boards being directed in the lateral direction (horizontal direction), moisture permeable waterproofing sheets 3 are attached at first to the vertical framework consisting of posts 1 and studs 2, and then, for the purpose of securing a ventilating space, furring strips 4 are attached via the moisture permeable waterproofing sheets 3 to the framework, the positions these furring strips 4 being aligned with the positions of the posts 1 and studs 2 as shown in FIG. 17. Thereafter, building boards (not shown in FIG. 17) are fastened to the furring strips 4 by means of nailing for instance.

On the other hand, in a vertical board siding work where the building boards are attached to the frame construction with the longitudinal direction of the building boards being directed upright (vertical direction), after the moisture permeable waterproofing sheets 3 are attached to the posts 1 and studs 2, furring strips 5 are horizontally attached via the moisture permeable waterproofing sheets 3 to the framework, thereby placing the furring strips 5 at several stages with a predetermined space being secured between each neighboring stages as shown in FIG. 18. In this case, a space S is required to be formed between the furring strips 5 which are disposed side by side in horizontal direction so as to secure a passageway for ventilation.

In the meantime, as an alternative method of fastening building boards to the framework where the aforementioned nailing is not employed, there is known a method of fastening the building boards by making use of a metallic fixture 60 which is exclusively dedicated for the building boards as shown in FIG. 19. This metallic fixture 60 is constructed such that the contacting face portion 61*a* thereof facing the framework is disposed parallel with and spaced away by a predetermined distance from the supporting face portion 61*b* thereof for supporting the rear surface of a building board, said predetermined distance being secured by the existence of the connection portion 61*c* and bent portion 61*d* of the metallic fixture 60. A mounting portion 62 extending horizontally is projected from the supporting face portion 61*b*, thereby permitting the shiplap portions of a couple of the neighboring upper and lower building boards 30A and 30B to be fitted therein and engaged with each other, the shiplap portions being formed respectively on the horizontal edge portions 31A and 31B, facing each other, of the neighboring upper and lower building boards 30A and 30B (see also FIG. 20).

When this metallic fixture 60 constructed as mentioned above is employed, it is possible to secure a sufficient ventilating space Sc between the framework and the rear surface of a building board due to the presence of the metallic fixture 60 which has been attached to the furring strips 4. FIG. 20 illustrates a horizontal board siding work of building boards 30 by making use of the metallic fixture 60. Namely, the installation of the building boards 20 can be performed as follows.

First of all, the lowermost building board 30B is horizontally positioned. Then, the upper horizontal edge portion 31B of the lowermost building board 30B is permitted to engage with the underside portion of mounting portion 62 of the metallic fixture 60, thereby positioning the metallic fixture 60. Then, the metallic fixture 60 is fixed, by means of screws or nails 50, to the furring strips 4 or to the posts 1 or studs 2 via the furring strips 4. Then, the lower horizontal edge portion 31A of the next upper building board 30A is permitted to engage with the upper side portion of mounting portion 62 of the metallic fixture 60 that has been fixed in advance, thereby horizontally positioning this upper building board 30A. Then, in the same manner as described above, the upper horizontal edge portion 31B of this building board 30A that has been horizontally positioned is permitted to engage with the underside portion of mounting portion 62 of another metallic fixture 60, and then, this metallic fixture 60 is fixed to the posts 1 or studs 2 by means of screws or nails 50. Thereafter, the same procedures as described above are repeated to attach the building boards 30 horizontally and in multistage to the side of a building, thereby accomplishing a decorative external sidewall.

This fastening method is advantageous in that there is little possibility of damaging the surface of the building boards 30 as seen in the case of the fastening work by way of nailing, and that the existence of the metallic fixture 60 cannot be externally recognized, thus making it possible to provide a fastened state of building boards which is very excellent in external appearance. Further, since a sufficient ventilation space Sc can be secured on the rear side of the building boards 30 that have been fastened to the framework, it is possible to inhibit the generation of dew on the rear surface of the building boards 30.

As described above, in the case of the fastening work of building boards by way of nailing, the nailing is generally limited to only the periphery of a building board, so that unless the nailing is performed strictly following a predetermined specification, it may become difficult to realize a sufficient wind pressure withstanding strength. Additionally, a touch-up coating for the head portion of nail is required to be performed, thus leaving an aesthetic problem.

On the other hand, in the case of the fastening method using the aforementioned metallic fixture, a large number of the furring strips 4 are required to be disposed in order to secure the ventilation space Sc. Therefore, the work load for attaching the furring strips 4 becomes enormous, giving a large influence to the working cost and working period. Additionally, in the case of using the aforementioned metallic fixture, the work for attaching a large number of metallic fixtures to the posts 1 or studs 2 is required.

In the case of a horizontal board siding work, the metallic fixture to be employed is constructed so as to be fitted with the shiplap joint portions (overlying tongue portion and underlying tongue portion) of building boards which are respectively formed on the upper and lower horizontal edge portions of each building board. Therefore, when a large surface load (such as wind pressure) is imposed on the front surface or rear surface of the building boards that have been fastened, the load is required to be endured by the metallic fixtures that have been disposed at the top and bottom sides of a building board. Since each piece of the building boards available in the market at present is relatively small in surface area, the employment of aforementioned metallic fixture for fastening such building boards would not raise any serious inconvenience. However, if the aforementioned conventional metallic fixture is employed for fastening a building board having a much larger surface area which is expected to be placed in the market in near future, it would become difficult to sufficiently endure the load of such a large building board by means of only the metallic fixtures being disposed at the top and bottom side edges of a building board, thus raising a possibility that the fastening portion of metallic fixture would be damaged by a large surface load.

SUMMARY OF THE INVENTION

The present invention has been made in view of the aforementioned circumstances, and therefore, an object of the present invention is to provide a novel fastening method of flat building boards which makes it possible to more easily perform the fastening work of building boards by way of so-called direct siding work wherein the building boards are enabled to be directly fastened to the posts and studs (structural framework) without employing furring strips, and which is capable of easily securing a sufficient ventilating space between the framework of a building and the rear surface of a building board, thus greatly contributing to the labor saving in the fastening work of building boards.

Another object of the present invention is to provide a novel fastening method of flat building boards which is designed such that even if an unexpected load (surface load) is imposed on the front surface or rear surface of a building board being fastened to the framework of a building, it is possible to prevent the load from being excessively concentrated on the joint portion between neighboring building boards, thereby preventing even a building board of large surface area from becoming unstable in the fastened state thereof.

A further object of the present invention is to provide a novel building board which can be handled in the same way as the conventional building board on the occasion of for example transporting the building board to a work site in spite of the fact that a special member for performing the aforementioned fastening method is attached to the rear surface of the building board.

With a view to realize the aforementioned objects, the present invention provides a method of fastening a building board to the framework of a building, the method being characterized in that a building board having a flat plate-like configuration and provided on the rear surface thereof with engaging protrusions and an elongated fixture which is adapted to be detachably engaged with the building board are employed, and that the building board is assembled in advance together with the elongated fixture through an engagement between the engaging protrusions and the elongated fixture, and then the elongated fixture is fixed to the framework of a building, thereby fastening the building board to the framework of a building.

According to the method of the present invention, the flat plate-like building board provided on the rear surface thereof with engaging protrusions and the elongated fixture to be engaged with the building board can be separately manufactured and transported to a work site. Further, since the height of the engaging protrusions can be confined to a relatively low level, a large number of building boards can be piled up one upon another with a thin buffering sheet being interposed between the building boards and transported in such a piled state without inviting any inconvenience. With respect to the fixture, since it is elongated in configuration, a large number of fixtures can be bundled together on the occasion of the transportation thereof.

In the work site, the fixture is engaged with the building board by taking advantage of the engaging protrusions attached to the rear surface of the building board. Preferably, a plurality of fixtures are attached to the building board along the longitudinal direction of the building board. While keeping this state where the fixtures are attached to the building board, each of the fixtures is partially fixed to the framework of a building (preferably, the vertical members such as the posts and studs of framework), thereby directly and easily fastening the building boards to the framework of a building (direct siding work).

As for the building board per se, it may be the same as those conventionally employed. A member which is capable of functioning as the aforementioned engaging protrusion, preferably an engaging piece such as a locking washer is fixed to plural portions of the rear surface of the building board by making use of a driving rivet whose tip opens while being driven which can be knocked into the rear surface of the building board. This fixing work using the locking washer can be easily performed at a building board-manufacturing factory, and therefore the board-siding work in the work site can be prevented from becoming complicated. Furthermore, since it is relatively easy to confine the height of the engaging protrusion such as the aforementioned engaging piece to several millimeters as measured from the rear surface of the building board, the presence of the engaging protrusion would not become any substantial obstruction in the transportation of the building boards.

The fixture according to the present invention is preferably constructed such that it comprises a main body which is designed to be entirely or partially contacted with the rear surface of a building board; engaging holes formed in the main body; a first rising portion formed at one end in the longitudinal direction of the main body; an engaging region formed at or near the first rising portion; an extension portion extending from the distal edge of said first rising portion in a direction away from and parallel with said main body; and an engaging tongue formed at the other end in the longitudinal direction of the main body; wherein said engaging tongue is positioned and shaped such that it can be inserted into said engaging region of the fixture attached to a neighboring building board as a couple of building boards each having the fixture attached to the rear surface thereof are positioned neighboring in vertical direction.

More preferably, the engaging holes should preferably be consisted of a first opening which is large enough to allow the engaging piece fixed to the rear surface of a building board to pass therethrough, and a second opening which is not large enough to allow said engaging piece to pass therethrough and is formed integral with said first opening.

On the occasion of fastening work of building boards, a large number of building boards each having the fixture attached to or engaged with the rear surface thereof are prepared at a work site. Then, the building board (a first building board) to be disposed at a lower level is fastened at first to the framework of a building by taking advantage of the fixture attached to or engaged with the rear surface of the building board. Then, the next building board (a second building board) to be disposed over the first building board is placed along the upper horizontal edge of the first building board and fastened to the framework of a building by inserting the engaging tongue of the fixture attached to or engaged with the rear surface of the second building board into the engaging region formed in the fixture of the first building board. As a result, these lower and upper building boards can be fastened contiguous with each other in the vertical direction and in a state wherein a couple of elongated fixtures engaged respectively with the rear surface of the building board are coupled with each other.

As for the specific configuration of the engaging region of the fixture, it may be optionally selected as long as it is configured such that the engaging tongue of the fixture attached to the rear surface of the neighboring upper building board can be introduced therein and that once the engaging tongue has been introduced into the engaging region, the fixture can be hardly disengaged from the engaging region by a load imposed thereon and directed forward (toward the building board).

For example, the engaging region of the fixture may be an opening formed in the first rising portion and designed so as to enable the engaging tongue to be introduced therein, or may be a region at one end in the longitudinal direction of the main body where the first rising portion is not located if the first rising portion is formed narrower than the width of the main body. In the latter case, the engaging tongue is allowed to be introduced into the rear side of the region where the first rising portion is not located, thereby realizing a desired engaging state.

According to this invention, the main body of the fixture may be provided on both sides thereof with a reinforcing member. This reinforcing member may be formed by bending a portion of the main body or by welding a separate member to the main body so as to integrate the separate member with the main body. When the fixture is provided with this reinforcing member, the flexural rigidity of fixture can be improved, thereby making it possible to reliably prevent the building board from being deformed by a back pressure. Further, the reinforcing member secures a ventilation space. The height of the reinforcing member should preferably be the same level as that of the extension portion. When the height of the reinforcing member is set to as mentioned above, the distal edge of the reinforcing member can be contacted with the framework of a building, thereby enabling the reinforcing member to reliably support the back face of a building board.

According to the present invention, the building board is provided on the rear surface thereof with a large number of the aforementioned engaging pieces which are arranged at predetermined intervals so as to enable a plurality of fixtures to be engaged therewith and spaced apart from each other in conformity with the intervals of the vertical members of the framework of a building. When the building board is constructed in this manner, the strength of the building board after the attachment thereof to the framework of a building can be reliably improved.

According to another embodiment of the present invention, the engaging protrusion is not attached at all to the building board, and instead, the fixture is fixed to the building board by making use of a driving rivet, etc. In this case, the fixture is fixed to the rear surface of a building board with at least the extension portion thereof being protruded from the peripheral edge of the building board. Preferably, a plurality of fixtures are fixed to the rear surface of a building board at predetermined intervals so as to conform with the intervals of the vertical members such as the posts and studs of the framework of a building to which the building board is to be fastened. As for the fixing method of the fixture to the building board, there is not any particular limitation. However, where the building board is a ceramic building board, a fixing method employing a driving rivet whose tip opens while being driven would be advantageous in the respects that the fixing work can be facilitated and that a more stabilized fixed state can be obtained. As an alternative method, it is also possible to employ an adhesive or to mold the fixtures integral with the building board on the occasion of manufacturing the building board.

The fastening of the building board according to this embodiment to the framework of a building can be performed in the same manner as in the case of the building board wherein the fixtures are engaged with the building board.

According to the building board-fastening method of the present invention, since the fixtures engaged with the rear surface of a building board are directly fixed to the framework of a building, so that as compared with the building board-fastening method employing a conventional metallic fixture, the work of fixing a large number of metallic fixtures can be omitted, thereby greatly saving the labor in the execution of the fixing work at the work site. Further, due to the provision of the rising portion formed at one end of the fixture, a sufficient ventilation space can be secured between the framework of a building and the rear surface of a building board. Therefore, the furring strips which are required in the conventional siding work can be entirely omitted, thus resulting in the simplification of work and labor saving.

Furthermore, since the fixture is elongated in configuration, and a plurality of fixtures are engaged with or fixed to the building board in such a manner that the fixtures are arrayed along the longitudinal direction of the building board with the main body of the fixture being directly contacted with the rear surface of a building board, the mechanical strength of the building board can be greatly enhanced, and even if the building board is of large surface area, it is possible to ensure a stable fastened condition of the building board. Further, even if a large magnitude of surface load is imposed on the rear surface of a building board that has been fastened to the framework of a building, the load can be mainly born not by the upper and lower horizontal edges of the building board but by the joint portion between neighboring fixtures (or the engaging portion between the engaging tongue and the engaging region) or by the engaging portion between the engaging protrusion attached to the rear surface of a building board and the fixture (or the engaging portion between the engaging protrusion and the engaging hole). Therefore, the shiplap joint portions (overlying tongue portion and underlying tongue portion) of building boards which are respectively formed on the upper and lower horizontal edge portions of each building board would not be substantially affected by such a surface load. As a result, the shiplap joint portions of building boards can be prevented from being damaged.

As described above, although there is not any particular limitation with respect to the raw material of the building board to be fastened, the employment of a ceramic building board is very effective as a building board to be fastened by making use of the fastened structure according to the present invention in view of the fact that a building board of large surface area is vulnerable to cracking due to a surface load. It is preferable that four sides or at least top and bottom horizontal sides of a building board should be respectively formed into a shiplap configuration in view of preventing rain water from penetrating through the joint portion between the neighboring building boards fastened in this manner.

The method of fastening building boards according to the present invention is advantageous in that it can be applied to any desired vertical members of a building. In particular, when the building to be worked is formed of a wooden framework like wood frame construction (two-by-four construction) or framework construction, or formed of an iron framework, the building boards can be easily and reliably installed by taking advantage of the vertical members constituting these frameworks.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferable embodiments of the present invention will be explained in details below with reference to the drawings.

Figure 1A:
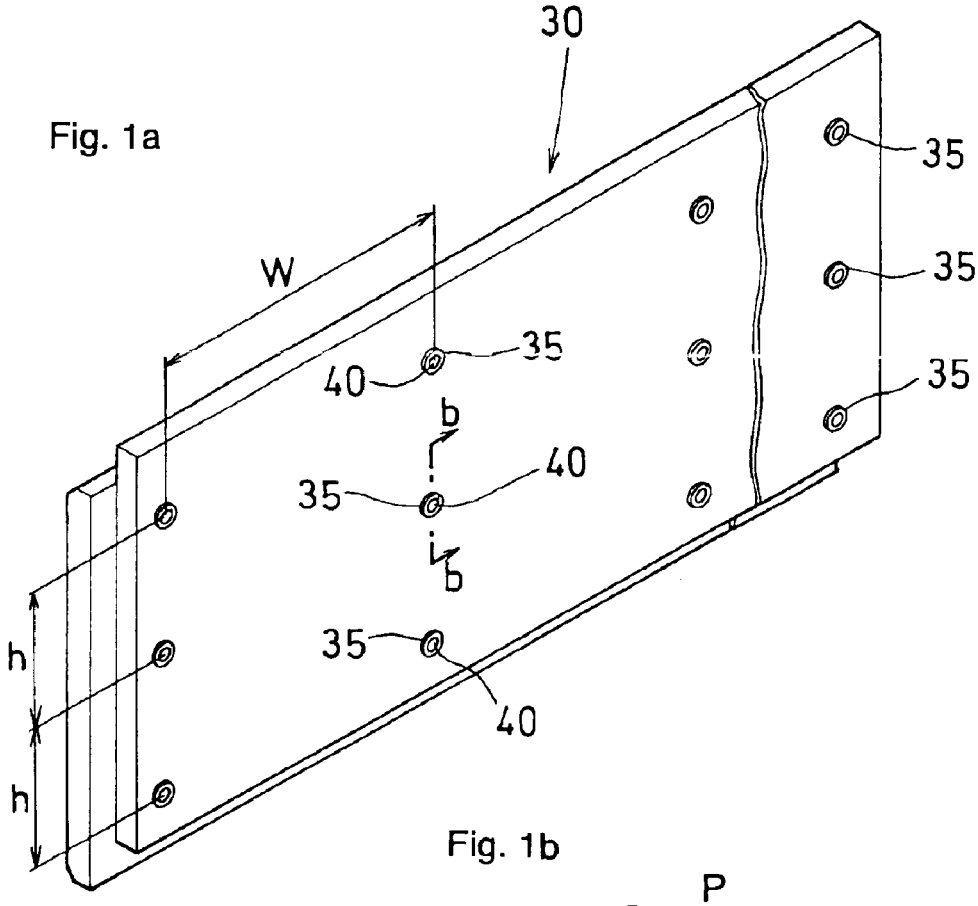
FIG. 1*a* is a perspective view illustrating the rear surface of a building board according to one embodiment of the present invention.

A building board 30 shown in FIG. 1*a* per se may be the same as the conventional ceramic building boards which are adapted to be fastened to the framework of a building in the siding work of a building. If required, a rabbet joint-forming work may be conducted on all four sides of a building board for enabling the shiplap joint of building boards to be achieved.

The building board 30 is provided on the rear surface thereof with a plurality of engaging washers (engaging pieces) 35 constituting one example of "engaging protrusion" as defined by the present invention and arranged at predetermined intervals "h". Namely, as shown in FIG. 1*a*, a plurality of engaging washers 35 are fixed at predetermined intervals "h" to the rear surface of the building board 30 so as to form a linear array thereof traversing the width of the building board 30. This array of the washers is repeatedly formed along the longitudinal direction of the building board 30, the interval between the arrays being conformed with the intervals W between the posts 1 and studs 2 of the framework of a building, to which the building board 30 is designed to be attached. By the way, the arrays of washers may be formed so as to conform in location with every posts and studs, or conform with only some of the posts and studs.

Figure 1B:
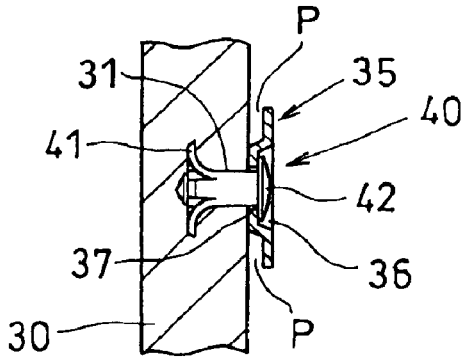
FIG. 1*b* is a cross-sectional view taken along the line b—b in FIG. 1*a* and shows one embodiment of the engaging protrusion.
Figure 2A:
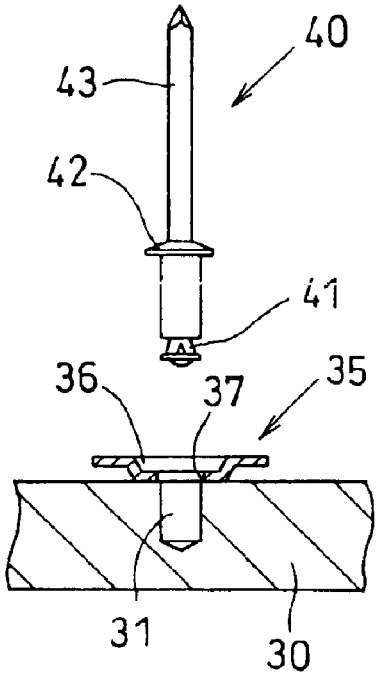
FIGS. 2*a*, 2*b*, 2*c* and 2*d* illustrate a method of attaching an engaging piece (a washer member) constituting the engaging protrusion to the rear surface of a building board by making use of a driving rivet whose tip opens while being driven.
Figure 2B:
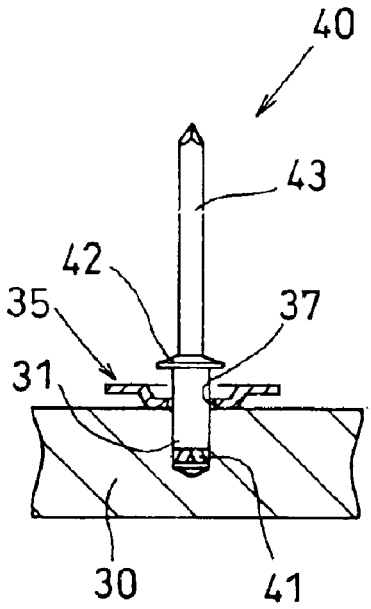
Figure 2C:
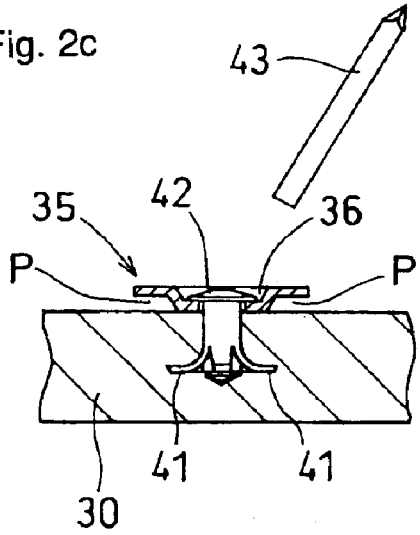

The engaging washers 35 in this embodiment is circular in plan view, and as shown in FIG. 1*b*, the central portion of the washers 35 is formed into a recessed portion 36 having a flat back surface. A hole 37 is formed at the center of the recessed portion 36 so as to allow a clamping screw or a rivet to be introduced therethrough for fixing the washers 35 to the rear surface of the building board 30. FIG. 2 illustrates the procedure for fixing the washers 35 to the rear surface of the building board 30 by making use of, for example, a driving rivet 40 whose tip opens while being driven. As shown in FIG. 2*a*, in the embodiment illustrated herein, bottomed holes 31 are formed in advance at predetermined locations of the rear surface of the building board 30. First of all, the washer 35 is positioned on the rear surface of the building board 30 in such a manner that the hole 37 of the washer 35 is aligned with the bottomed hole 31. Then, as shown in FIG. 2*b*, the driving rivet 40 whose tip opens while being driven is set inside the bottomed hole 31 through the hole 37.

Figure 2D:
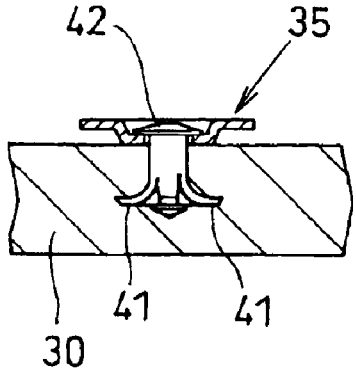

Then, the driving rivet 40 set in this manner is knocked down into the bottomed hole 31 by making use of a driving machine (not shown). As a result, the tip-end 41 of the driving rivet 40 is caused to expand and thrust into the building board 30. As a result, the recessed portion 36 of the washer 35 is clamped and immobilized between a rivet head 42 and the rear surface of the building board 30, thus fixing the washer 35 to the rear surface of the building board 30. When the washer 35 is fixed to the rear surface of the building board 30 in this manner, a space P is formed between the peripheral portion of washer 35 around the recessed portion 36 and the rear surface of the building board 30. After the washer 35 is clamped to the rear surface of the building board 30 by making use of the rivet 40, the supporting rod 43 of the rivet 40 is removed by any suitable means (FIG. 2*c*), thereby finishing the fixing work of the washer 35 to the rear surface of the building board 30 (FIG. 2*d*). In the same manner as illustrated above, the fixing of the washer 35 to predetermined locations of the rear surface of the building board 30 is repeated, thereby forming the building board 30 of the present invention as shown in FIG. 1*a*.

As shown in FIGS. 1 and 2, the building board 30 attached with the washer 35 has a thickness which is increased by the thickness of the washer 35. However, since this increment is limited in magnitude and the projected portions are substantially uniformly dispersed throughout the entire rear surface of the building board 30, a large number of building boards can be stably piled up one upon another with a thin buffering sheet (not shown) being interposed between the building boards on the occasion of transporting the building boards 30. Further, even if the building boards 30 are piled up in this manner, the height thus piled (thickness-wise direction) of the building boards 30 would not be substantially increased.

Figure 3:
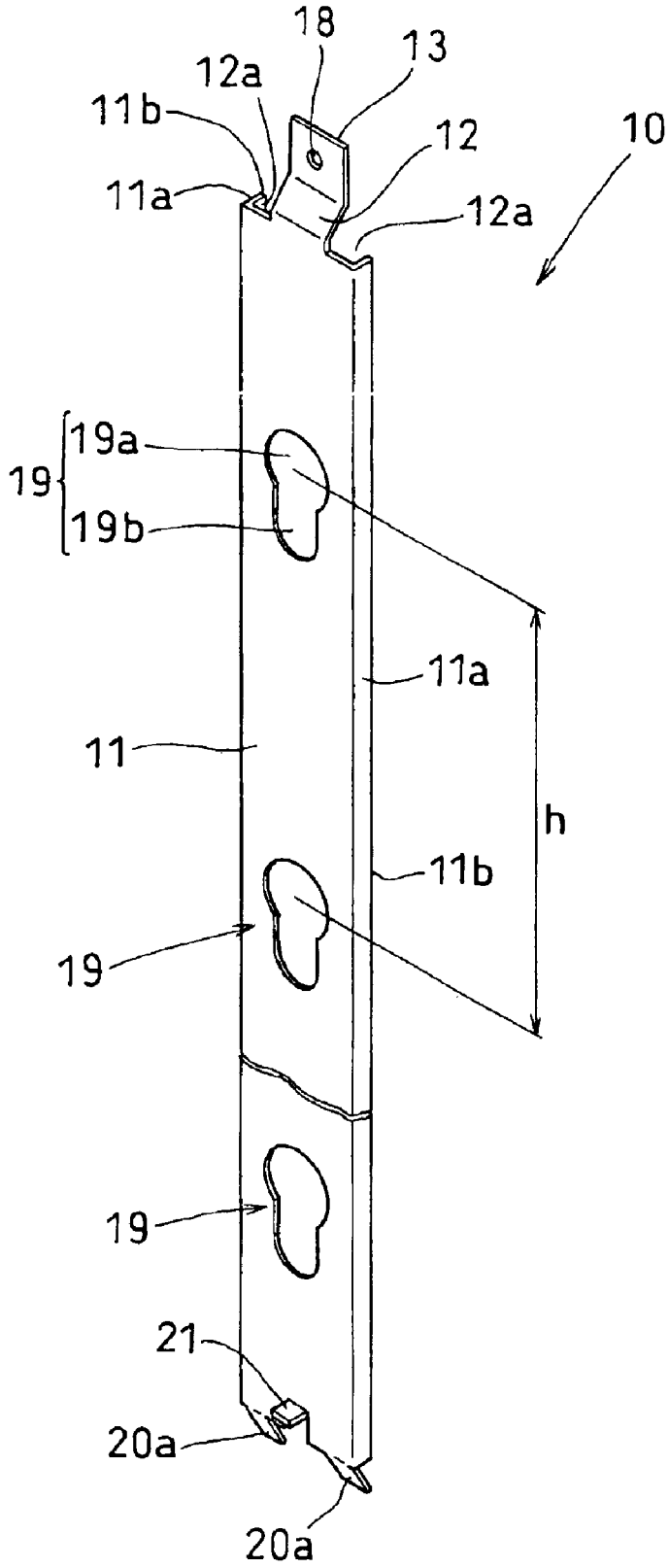
FIG. 3 is a perspective view illustrating one embodiment of the fixture according to the present invention.

Next, the elongated fixture 10 having, as an engaging protrusion, the washer 35 engaged therewith will be explained. FIG. 3 shows a perspective view illustrating the one example of the fixture 10. The fixture 10 is entirely formed of steel, and comprises a flat main body 11, a rising portion 12 which is extended from the upper end of the main body 11 and bent backward by a predetermined angle, and an extension portion 13 extending from the distal edge of the rising portion 12 in a direction away from and parallel with the main body 11 (upward direction). Both rising portion 12 and extension portion 13 are formed to have a narrower width as compared with the width of the main body 11 and are located coaxial with the main body 11. Therefore, on both sides of the rising portion 12, there are formed a pair of cut-out regions 12*a*. Further, the extension portion 13 is provided with a locking hole 18.

On both sides of the main body 11, there are formed a pair of bent portions 11*a* which are extended backward from the both sides of the main body 11. These bent portions 11*a* are capable of functioning as a reinforcing member for the main body 11. The level of the distal end 11*b* of the bent portions 11*a* (i.e. the height of the reinforcing member) should preferably be substantially the same as the level of the rear surface of the extension portion 13. When the height of the bent portions 11*a* is set to as mentioned above, the distal end 11*b* of the bent portions 11*a* can be contacted with the framework of a building, thereby enabling the bent portions 11*a* to reliably support the back face of the building board being fastened.

A couple of engaging tongues 20*a* are extended from both edge portions of the lower end of the main body 11 and are bent backward by a predetermined angle. In this case, the interval between this couple of engaging tongues 20*a* is made somewhat larger than the lateral width of the rising portion 12. Although it is not essential, a bent portion 21 is extended from the central portion of the lower end of the main body 11 and inclined forward. As explained hereinafter, the lower edge portion of the building board 30 is designed to be mounted on this bent portion 21 on the occasion of attaching the fixture 10 to the building board 30, thereby determining the positioning between the building board 30 and the fixture 10.

Furthermore, the main body 11 is provided with a plurality of engaging holes 19 which are designed to be detachably engaged with the washers 35 fixed to the rear surface of the building board 30, thereby enabling the elongated fixture 10 to be detachably engaged with the building board 30. Each of the engaging holes 19 is consisted of a first opening 19*a* which is large enough to allow the engaging washer 35 fixed to the rear surface of the building board to pass therethrough, and a second opening 19*b* which is not large enough to allow the engaging washer 35 to pass therethrough and is formed integral with the first opening 19*a*.

As shown in FIG. 3, Each of the engaging holes 19 is configured such that the upper portion thereof or the side which is closer to the extension portion 13 is constituted by the first opening 19*a*. By the way, the interval "h" between the engaging holes 19 is made identical with the interval "h" (in the direction traversing the width of the building board 30) of the engaging washers 35 which are fixed to the rear surface of the building board 30.

The fixture 10 is constructed such that the length of the main body 11 is made substantially identical with the width of the building board 30 to be fastened, and the height of the rising portion 12 is optionally determined depending on the magnitude of ventilation space desired to be formed as the building board 30 is fastened to the framework of a building.

Figure 4A:
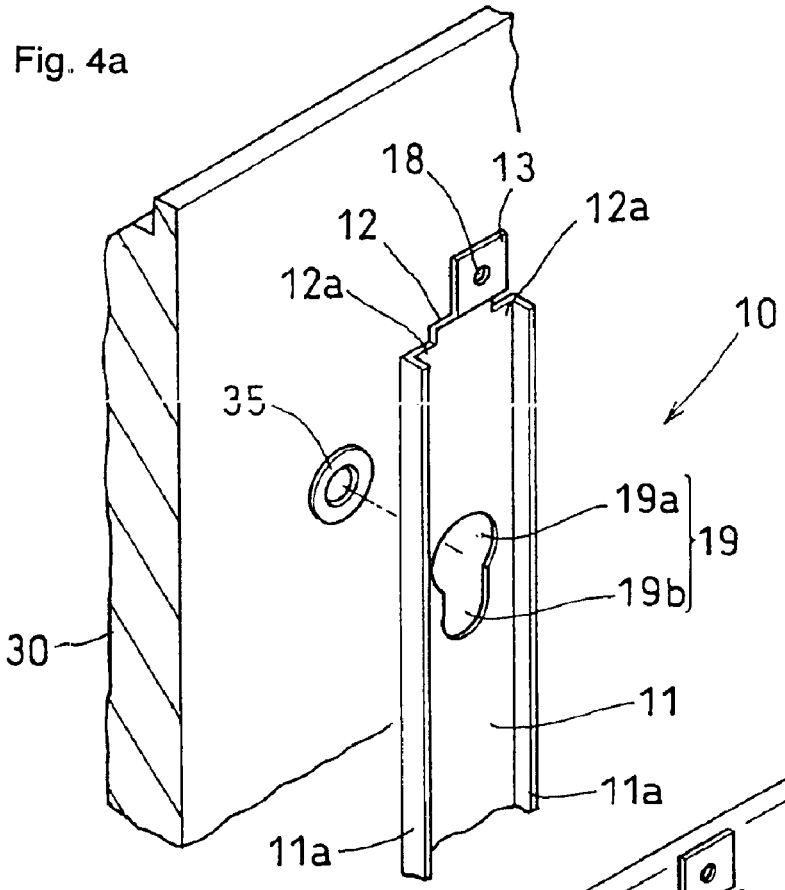
FIGS. 4*a* and 4*b* are perspective views illustrating the procedure of engaging the fixture of FIG. 3 with the building board shown in FIG. 1.
Figure 4B:
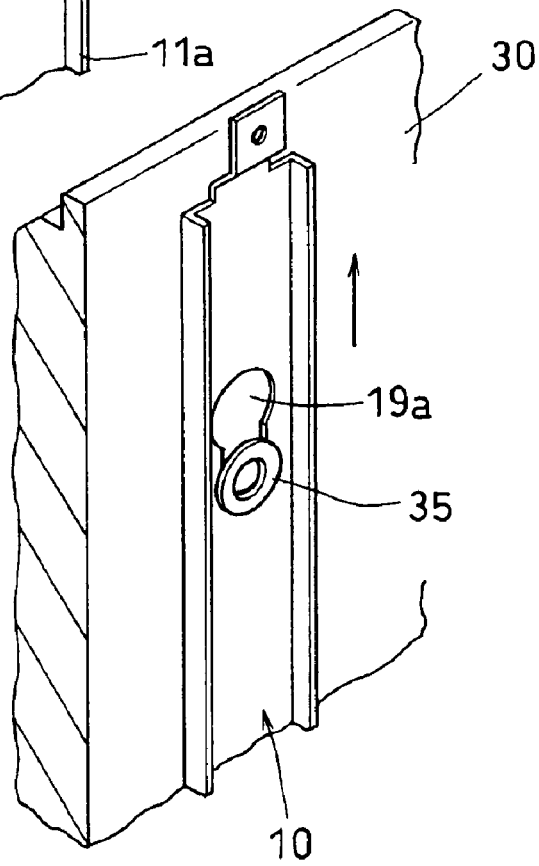

The fixture 10 can be engaged with the rear surface of the building board 30 as follows. First of all, as shown in FIG. 4, the fixture 10 is placed near the rear surface of the building board so as to align the fixture 10 with the array of washers 35 fixed to the rear surface of the building board. In this case, the position of each of the first openings 19*a* of the fixture 10 is aligned with the position of each of the washers 35 (FIG. 4*a*). Under this condition, the fixture 10 is shifted toward the rear surface of the building board 30 so as to allow the washer 35 to pass through the first openings 19*a*, thereby causing the rear surface of the fixture 10 to be contacted with the rear surface of the building board 30. Under this condition, the fixture 10 is lifted upward so as to allow the peripheral portion of the second opening 19*b* of engaging hole 19 to be introduced into the space P formed between the rear surface of the washer 35 and the rear surface of the building board 30. As a result, the fixture 10 is engaged with the rear surface of the building board 30 (FIG. 4*b*).

The engaging position of the fixture 10 in the longitudinal direction thereof may be regulated by the position where the lower brim portion of the second opening 19*b* is contacted with the recessed portion 36 of the washer 35. Alternatively, when a bent portion 21 is provided at the lower end of the main body 11 of the fixture 10 as mentioned above, the positioning of the fixture 10 may be regulated by mounting the lower edge of the building board 30 being fastened on the bent portion 21. According to the latter method, a positioning of higher precision can be realized. In either cases, the positioning of the fixture 10 is performed in such a manner that at least the hole 18 portion of the extension portion 13 is protruded from the upper edge of the building board 30 after the building board 30 has been engaged with the building board 30.

Figure 5:
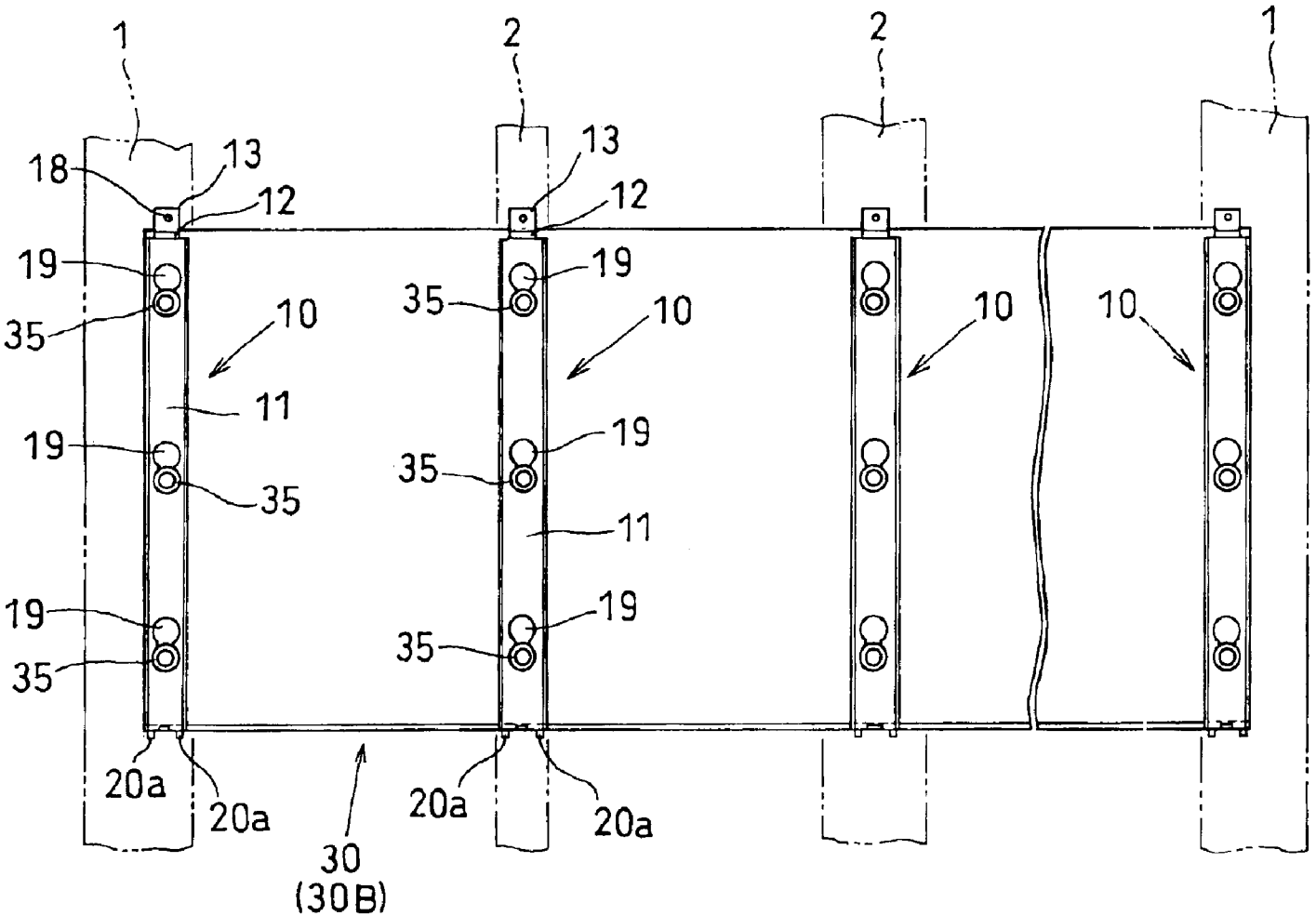
FIG. 5 is an elevational side view illustrating a state wherein the fixture of FIG. 3 is engaged with the building board shown in FIG. 1.

In the same manner as described above, a required number of fixtures 10 are attached to the building board 30 along the longitudinal direction of the building board 30. In this case, as shown in FIG. 5, the fixture 10 may be engaged with all of the arrays of washers or with some of the arrays of washers as required. The number of the fixture 10 can be suitably selected depending on the fastening strength of the building board to the framework of a building or on the layout of the vertical members of the framework of a building. FIG. 5 shows a state wherein the building board 30 having the fixtures 10 engaged therewith is fastened to the framework of a building.

The building board 30 engaged, through the rear surface thereof, with a required number of the fixtures 10 can be fastened to the framework of a building as follows. First of all, as shown in FIG. 5, the building board 30 (30B) to be disposed at a lower position is arranged in such a manner that the positions of the fixtures 10 is aligned with the positions of posts 1 and studs 2, and then, the building board 30 is pushed toward the framework of a building so as to allow the extension portions 13 of the fixtures 10 to be contacted with the posts 1 and studs 2. Under this condition, a screw 50 is screwed, through the hole 18 formed in the extension portion 13, into the post 1 or stud 2, thereby fixing the fixtures 10 to the posts 1 and studs 2. After all of the fixtures 10 attached to a single building board 30B have been fixed the posts 1 or studs 2, another building board 30B is disposed on one side of the building board 30B that has been fastened to the posts 1 or studs 2, and the same fastening work as described above is repeated.

Figure 6:
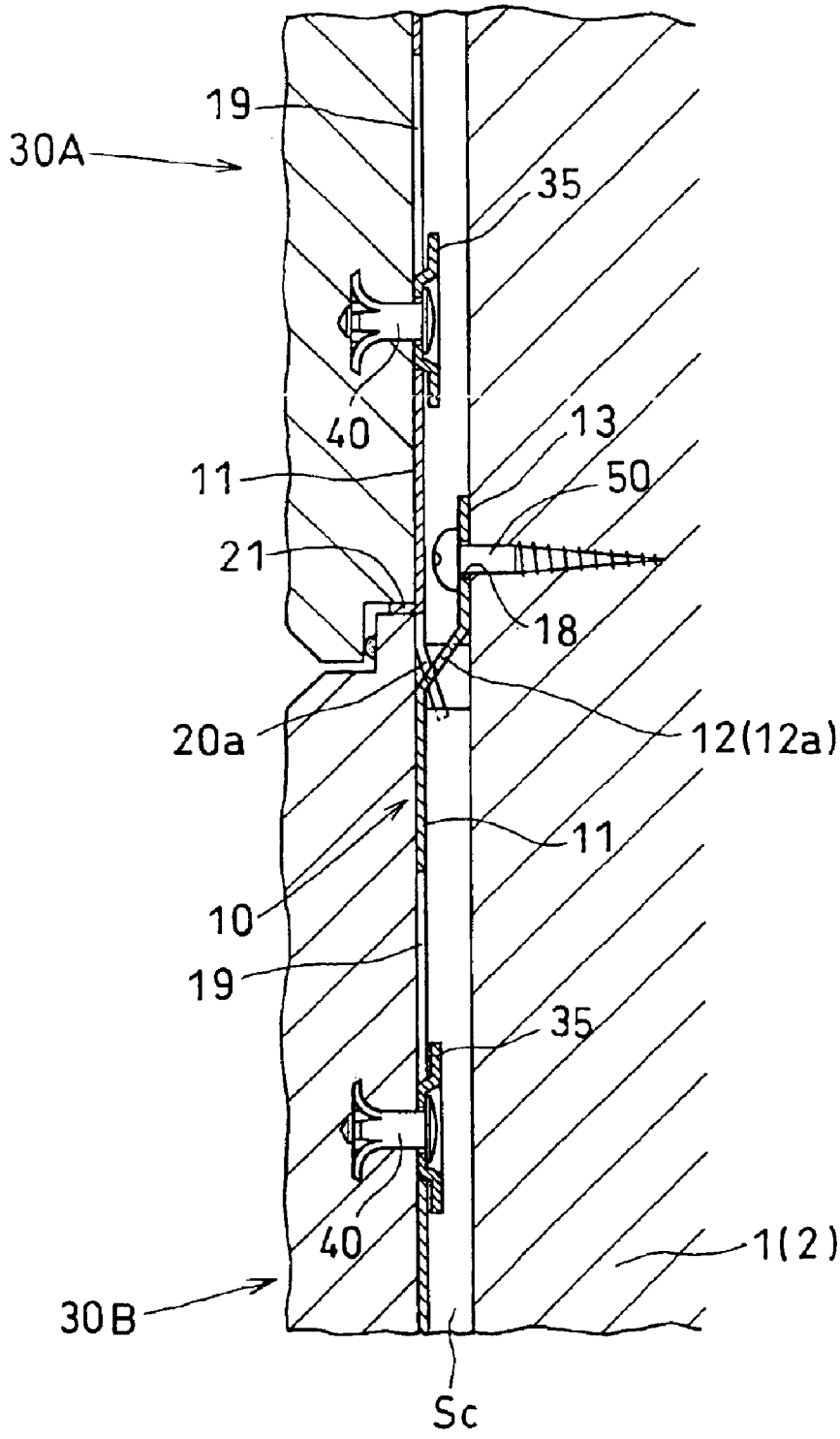
FIG. 6 is a cross-sectional view illustrating a state wherein the building board is fastened to the framework of a building by making use of the fixture of FIG. 3.

Then, the fastening work of upper building board 30A is performed. First of all, the positions the fixtures 10 of the upper building board 30A are aligned with the fixtures 10 of the lower building board 30B. Then, under this condition, the lower horizontal edge (overlying tongue portion) of the upper building board 30A is placed on and along the upper horizontal edge (underlying tongue portion) of the lower building board 30B. As a result, a couple of engaging tongues 20*a* formed contiguous with the lower end of each of the fixtures 10 of the upper building board 30A are allowed to be introduced into a pair of cut-out regions 12*a* formed on both sides of the rising portion 12 of the fixtures 10 of the lower building board 30B. As a result, the fixtures 10 of the upper building board 30A are coupled with the fixtures 10 of the lower building board 30B (see FIG. 6).

Under this condition, the upper building board 30A is firmly pressed against the framework of a building so as to allow the extension portions 13 of the fixtures 10 to be contacted with the posts 1 and studs 2. Under this condition, a screw 50 is screwed, through the hole 18 formed in the extension portion 13, into the post 1 or stud 2 in the same way as in the case of the lower building board 30B, thereby fixing the fixtures 10 to the posts 1 and studs 2. Thereafter, a required number of building boards are fastened side by side or one upon another in the same manner as explained above, thereby constructing a decorative wall of a building according to the present invention.

As explained above, according to the aforementioned fastening method, since a sufficient space (a ventilating space Sc) can be secured between the framework of a building and the rear surface of the building board 30 without employing furring strips (i.e. even though the building boards are directly fastened to the structural framework), the fastening work of building boards can be performed, greatly saving the labor for the work.

Furthermore, since the fixture 10 is elongated in configuration, and a plurality of fixtures 10 are attached, through an engagement between a plurality of engaging holes 19 and the washers 35 fixed to the rear surface of the building board 30, to the building board 30 in such a manner that the fixtures 30 are arrayed along the longitudinal direction of the building board with the main body of the fixture being directly contacted with the rear surface of the building board 30, the mechanical strength of the building board 30 can be greatly enhanced. As a result, even if the building board 30 is of large surface area, it is possible to ensure a stable fastened condition of the building board 30.

Furthermore, even if a surface load is imposed on the rear surface of the building board 30 that has been fastened to the framework of a building, the load can be mainly born not by the upper and lower horizontal edges of the building board 30 but by a plurality of the engaged portions between the engaging holes 19 (the second opening 19*b*) and washers 35 and by the joint portions between the fixtures 10. Therefore, the shiplap joint portions (overlying tongue portion and underlying tongue portion) of the building boards 30 which are respectively formed on the upper and lower horizontal edge portions of each building board would not be substantially affected by such a surface load. As a result, the shiplap joint portions of building boards can be prevented from being damaged.

Figure 7:
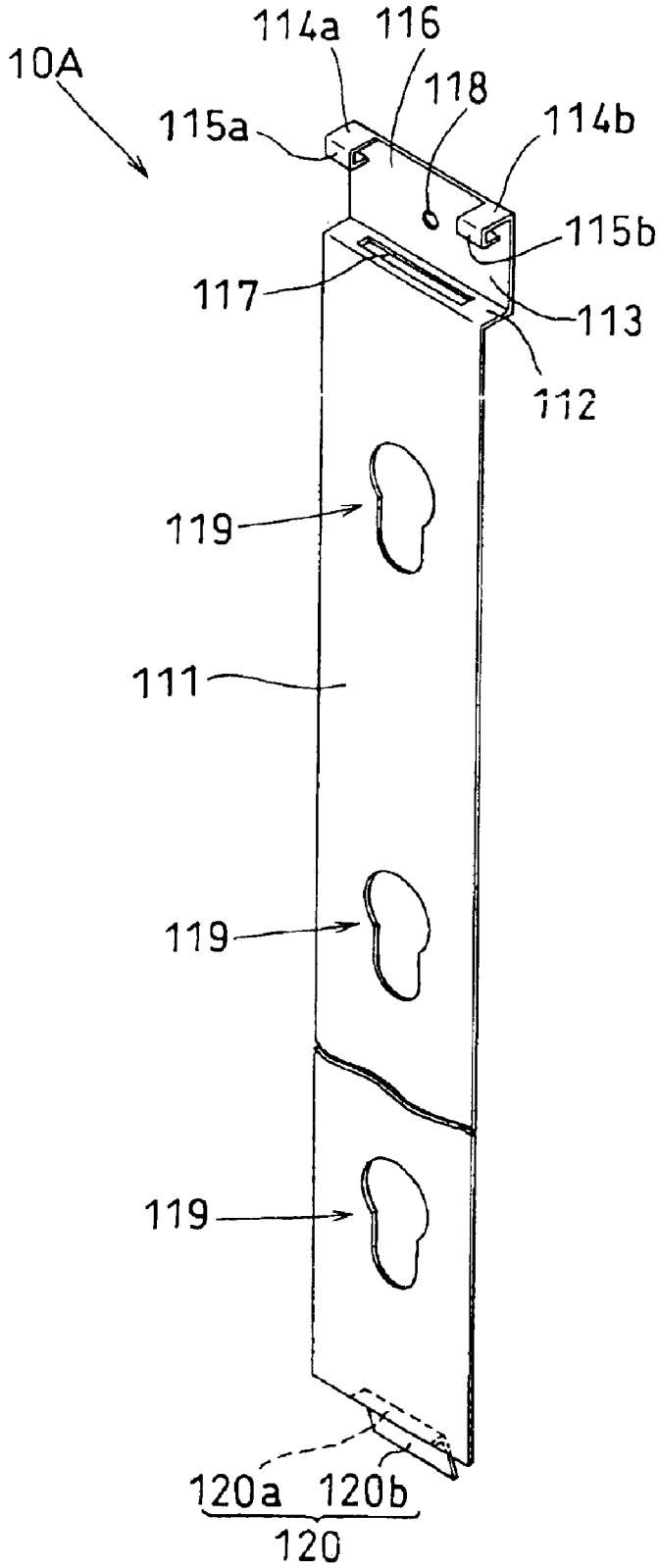
FIG. 7 is a perspective view showing a fixture according to another embodiment of the present invention.

FIG. 7 shows another embodiment of the fixture. This fixture 10A comprises a flat main body 111, a first rising portion 112 which is extended from the upper end of the main body 111 and bent backward by an angle of 90 degrees, and an extension portion 113 extending from the distal edge of the first rising portion 112 in a direction away from and parallel with the main body 111 (upward direction).

A couple of second rising portions 114*a* and 114*b* are extended from both distal edge portions of the extension portion 113 and are bent forward (toward where the main body 111 is located), thus extending substantially parallel with the first rising portion 112. Additionally, a couple of sustaining planes 115*a* and 115*b* are formed contiguous respectively with the distal edge portions of the second rising portions 114*a* and 114*b* and bent downward by an angle of 90 degrees so as to make the sustaining planes 115*a* and 115*b* substantially flush with the rear surface of the main body 111. The distal end of each of the sustaining planes 115*a* and 115*b* may be further bent toward the extension portion 113 as shown in FIG. 7. As a result, there is formed a cut-out region 116 between this pair of second rising portions 114*a* and 114*b*, this cut-out region 116 being extended up to the extension portion 113.

Further, the first rising portion 112 is provided with an opening 117 having a length which corresponds to the lateral width of the cut-out region 116. This opening 117 corresponds to the "engaging region" as defined by the present invention. Further, a hole 118 is formed in the extension portion 113, and the main body 111 is provided with a plurality of engaging holes 119 of the same configuration and in the same manner as illustrated with reference to the fixture 10 shown in FIG. 3.

The main body 111 is further provided with an engaging tongue 120 which is extended from the lower end of the main body 111 and composed of a horizontal portion 120*a* which is formed contiguous with the lower end of the main body 111 and bent by an angle of about 90 degrees, and an oblique portion 120*b* which is formed contiguous with the distal end of the horizontal portion 120*a* and bent downward by a desired angle. In this case, the lateral width of the engaging tongue 120 is made somewhat narrower than the length of the engaging hole 117 formed in the first rising portion 112. The extending length of the horizontal portion 120*a* is made substantially identical with the distance where the fore-brim of the engaging hole 117 is located as measured from the upper edge of main body 111.

The manner of employing this fixture 10A is the same as illustrated with reference to the fixture 10 shown in FIG. 3. As for the construction of the building board 30 to be engaged with this fixture 10A, it may be the same as illustrated with reference to FIG. 1.

However, the employment of this fixture 10A is advantageous in the mounting work of building boards as explained below. Namely, on the occasion of positioning the lower horizontal edge (overlying tongue portion) of the upper building board 30A on and along the upper horizontal edge (underlying tongue portion) of the lower building board 30B, the upper building board 30A can be moved downward while allowing the rear surface of the upper building board 30A to be guided by a couple of sustaining planes 115*a* and 115*b* which are formed contiguous with the second rising portions 114*a* and 114*b* of the fixture 10A of the lower building board 30B.

When the upper building board 30A is mounted on the lower building board 30B in this manner, the oblique portion 120*b* of fixture 10A fixed to the upper building board 30A is kept introduced into the engaging hole 117 formed in the fixture 10A of the lower building board 30B, so that both fixtures 10A of the upper and lower building board 30A and 30B can be coupled to each other in a stable manner.

Figure 8:
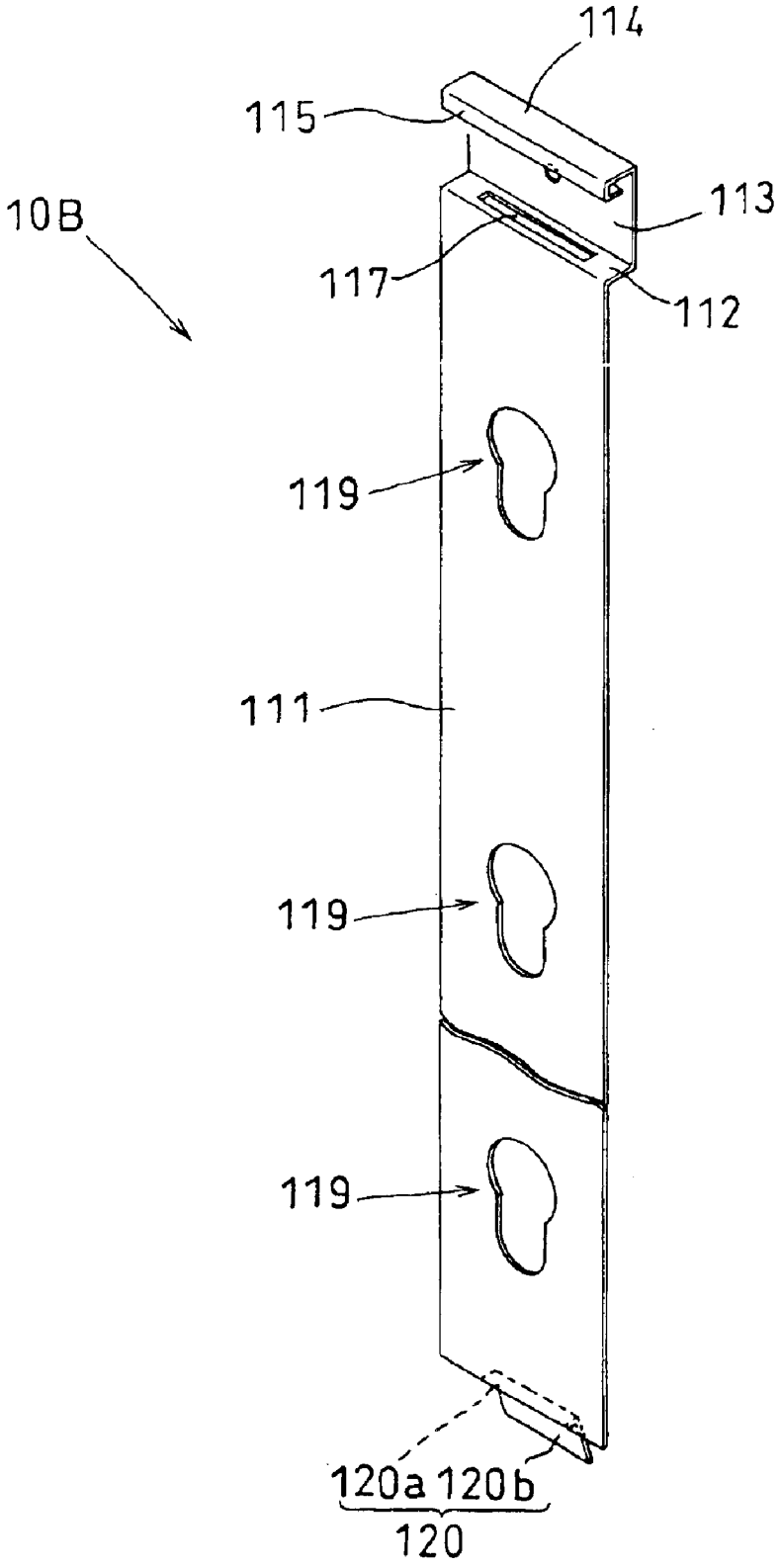
FIG. 8 is a perspective view showing a fixture according to a further embodiment of the present invention.

FIG. 8 shows a further embodiment of the fixture. This fixture 10B differs from the fixture 10A shown in FIG. 7 in the respect that the second rising portion 114 is formed of a single flat portion without accompanying the cut-out portion 116. Other constituent members are the same as those shown in FIG. 7 and hence are referred to by the same numbers.

This fixture 10B is advantageous in that since the cut-out portion 116 is not existed therein, the molding work of the second rising portion 114 can be simplified and at the same time, the mechanical strength of the fixture 10B can be improved. On the occasion of coupling a pair of building boards (each carrying the fixtures 10B) to each other, the upper building board 30A is slightly inclined forward at first and then, allowed to fall down toward the lower building board 30B. As a result, a couple of fixtures 10B can be easily coupled to each other (the engagement between the engaging tongue 120 and the engaging hole 117). Thereafter, the upper building board 30A is pressed against the framework of a building, thereby allowing the lower end of rear surface portion of the upper building board 30A to be supported by the sustaining plane 115 formed contiguous with the second rising portion 114 of the fixture 10 attached to the lower building board 30B, thus advantageously realizing a stable coupled state of the upper and lower building boards.

Figure 1C:
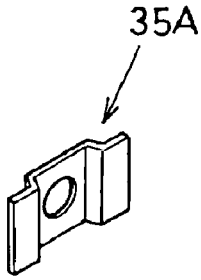
FIG. 1*c* is a perspective view of an engaging piece constituting the engaging protrusion according to another embodiment.

In the foregoing illustrations, the washer 35 having a circular configuration in plan view is exemplified as an engaging piece constituting the engaging protrusion of the present invention. However, the engaging piece may be any other configurations other than the washer 35 as long as it is capable of securing a predetermined space P between the engaging piece and the rear surface of a building board and also capable of detachably engaged with the engaging hole 19 formed in the fixture 10. For example, it may be an engaging piece 35A having a rectangular configuration in plan view as shown in FIG. 1*c*.

Figure 9:
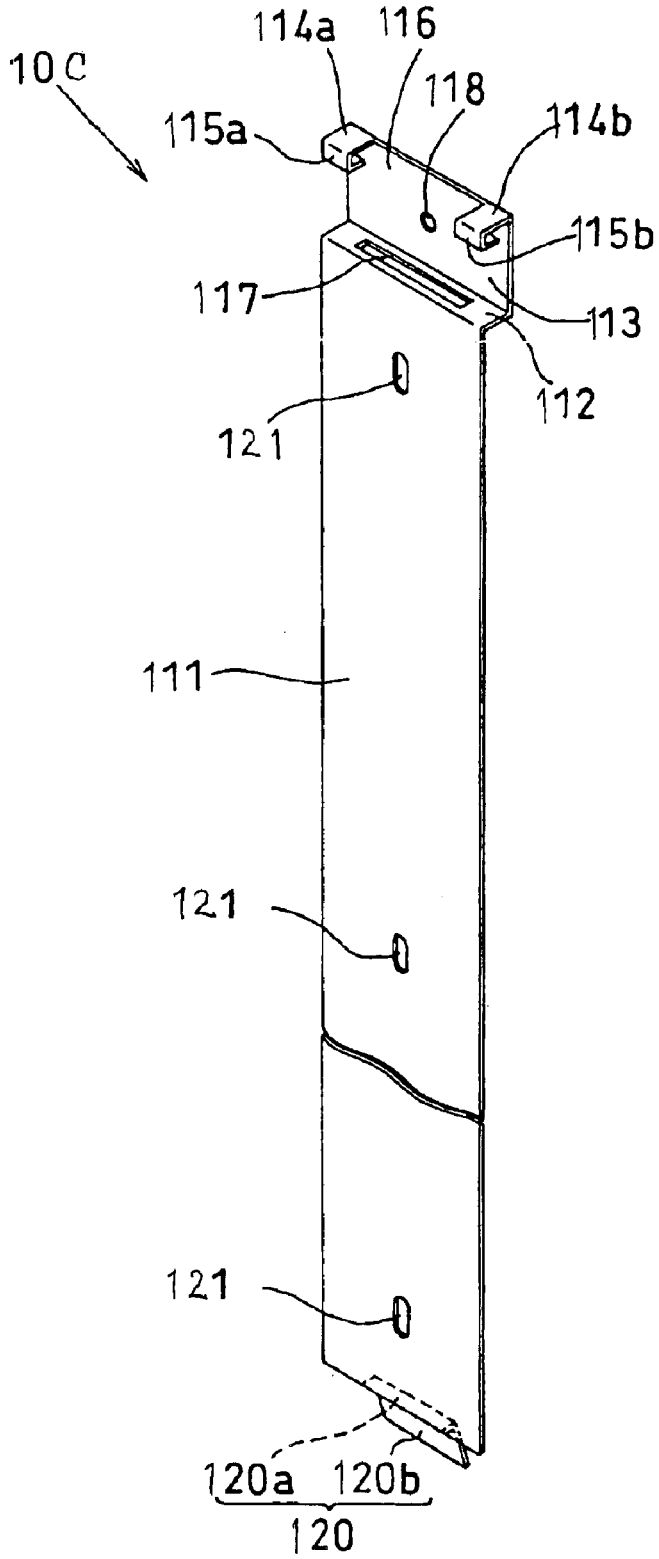
FIG. 9 is a perspective view showing a fixture according to a further embodiment of the present invention.

FIG. 9 shows a further embodiment of the fixture. This fixture 10C differs from the fixture 10A shown in FIG. 7 in the respect that a hole 121 is substituted for the engaging hole 119. Other constituent members are the same as those shown in FIG. 7, and hence the explanation thereof is omitted by referring them by the same numbers.

Figure 10:
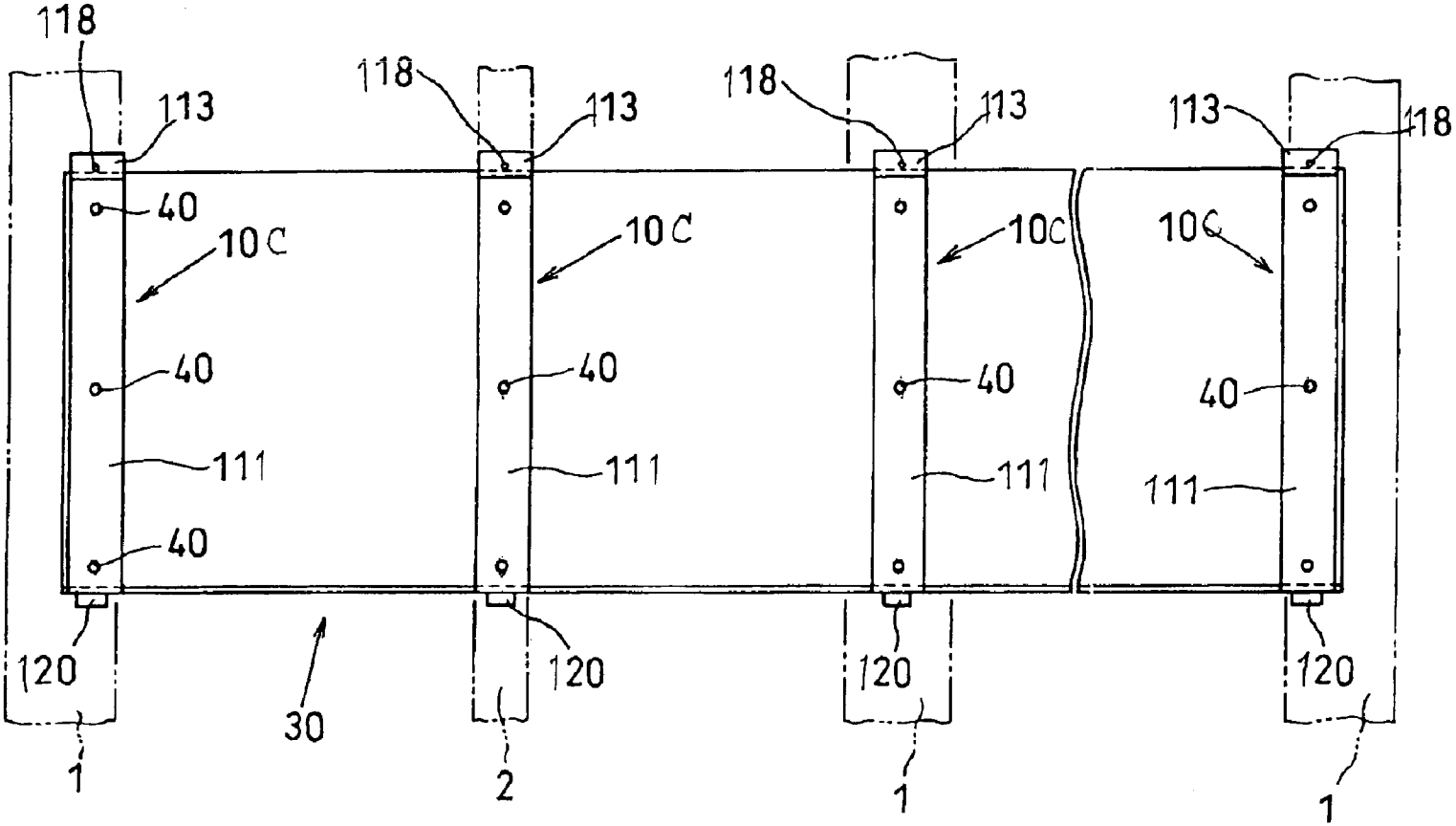
FIG. 10 is an elevational side view illustrating one embodiment of the building board having the fixture of FIG. 9 attached to the rear surface thereof according to the present invention.

FIG. 10 shows the building board 30 carrying the aforementioned fixtures 10C which are fixed to the rear surface of the building board 30. As shown in FIG. 10, a plurality of fixtures 10C are fixed to the rear surface of the building board 30 in such a manner that the region of the hole 118 formed in the extension portion 113 is protruded from the upper edge of the building board 30 and that the fixtures 10C are spaced apart from each other by a predetermined interval. The aforementioned interval of the fixtures 10C may be suitably determined depending on the intervals of the posts 1 or studs 2 of a building to which the building board 30 is to be fastened. Further, the fixtures 10C may be positioned and fixed to the building board in conformity with all or some of the posts 1 or studs 2 of a building.

Figure 11A:
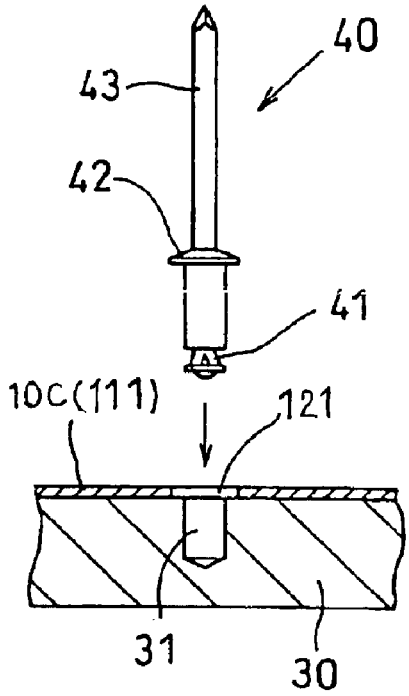
FIGS. 11*a*, 11*b*, 11*c*, and 11*d* are partial cross-sectional views illustrating a method of attaching the fixture of FIG. 9 to the rear surface of a building board by making use of a driving rivet whose tip opens while being driven.
Figure 11B:
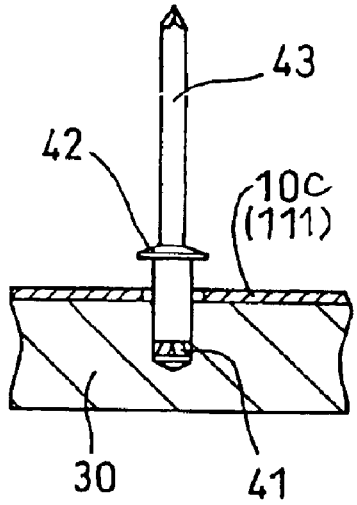

Although there is not any particular limitation with respect to the fixing method of fixture, the employment of a driving rivet 40 whose tip opens while being driven is preferable. FIG. 11 illustrates the procedure for fixing the fixtures 10C to the rear surface of the building board 30 by making use of the driving rivet 40 whose tip opens while being driven. As shown in FIG. 11*a*, bottomed holes 31 are formed in advance at predetermined locations of the rear surface of the building board 30 where the holes 121 are located as the fixture 10C is positioned at the fixing position thereof. First of all, the fixture 10C is positioned over the rear surface of the building board 30 in such a manner that the holes 121 thereof are aligned with the bottomed holes 31. Then, as shown in FIG. 11*b*, the driving rivet 40 whose tip opens while being driven is set inside the bottomed hole 31 through the hole 121.

Figure 11C:
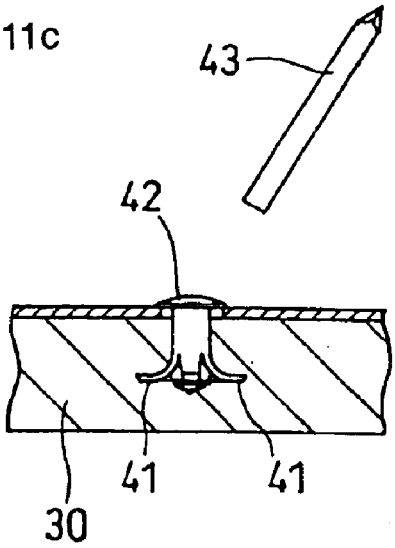
Figure 11D:
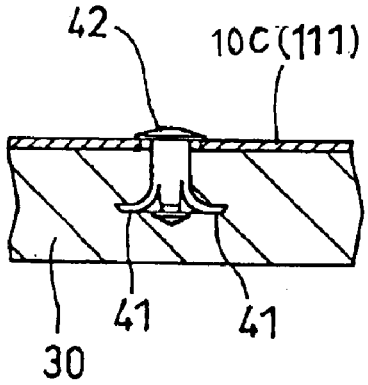

Then, the driving rivet 40 set in this manner is knocked down into the bottomed hole 31 by making use of a driving machine (not shown). As a result, the tip-end 41 of the driving rivet 40 is caused to expand and thrust into the building board 30 as shown in FIG. 11*c*. As a result, the flat main body 111 of the fixture 10C is clamped in an immobilized state between a rivet head 42 and the rear surface of the building board 30. Thereafter, the supporting rod 43 of the rivet 40 is removed by any suitable means (FIG. 11*c*), thereby finishing the fixing work of the fixture 10C to the rear surface of the building board 30 (FIG. 11*d*).

Figure 12:
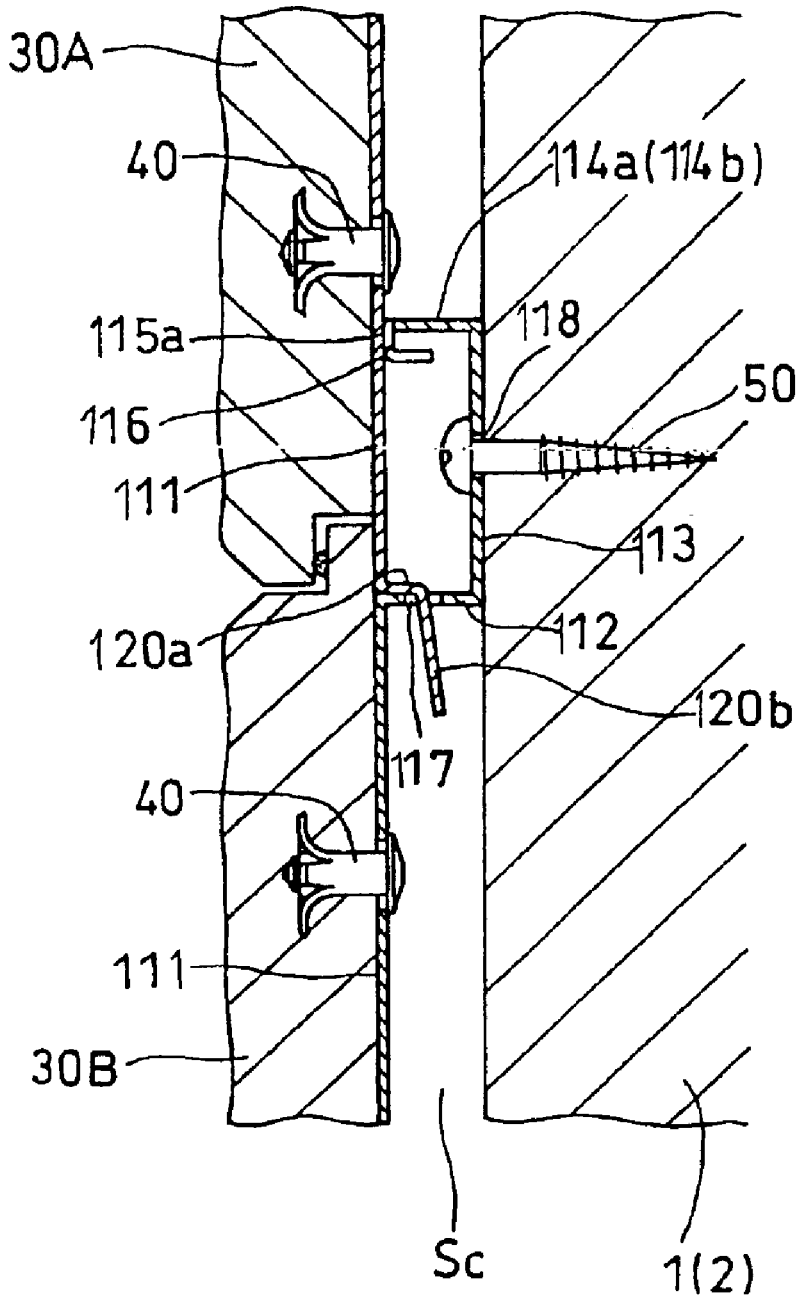
FIG. 12 is a cross-sectional view illustrating a state wherein the building board is fastened to the framework of a building by making use of the fixture of FIG. 9.

The fastening of a building board carrying a desired number of the fixtures 10C to the framework of a building can be conducted in the same manner as illustrated above with reference to the fastening of a building board carrying the fixtures 10A to the framework of a building. FIG. 12 is a cross-sectional view wherein the lower building board 30B and the upper building board 30A are fastened to the post 1 or stud 2.

As described above, according to the aforementioned fastening construction, since a sufficient space (a ventilating space Sc) can be secured between the framework of a building and the rear surface of the building board 30 without employing furring strips (i.e. even though the building boards are directly fastened to the structural framework), the fastening work of building boards can be performed, greatly saving the labor for the work.

Furthermore, since the fixture 10*c* is elongated in configuration, and a plurality of fixtures 10C are attached, under the condition wherein the main body 111 is closely contacted with the rear surface of the building board 30, to the building board 30 so as to enable the fixtures 30 to be arrayed along the longitudinal direction of the building board, the mechanical strength of the building board 30 can be greatly enhanced. As a result, even if the building board 30 is of large surface area, it is possible to ensure a stable fastened condition of the building board 30.

Furthermore, even if a surface load is imposed on the rear surface of the building board 30 that has been fastened to the framework of a building, the load can be mainly born not by the upper and lower horizontal edges of the building board 30 but by the joint portions between the fixtures 10 (the engagement between the engaging tongues 120 and the engaging holes 117). Therefore, the shiplap joint portions (overlying tongue portion and underlying tongue portion) of the building boards 30 which are respectively formed on the upper and lower horizontal edge portions of each building board would not be substantially affected by such a surface load. As a result, the shiplap joint portions of building boards can be prevented from being damaged.

Figure 13:
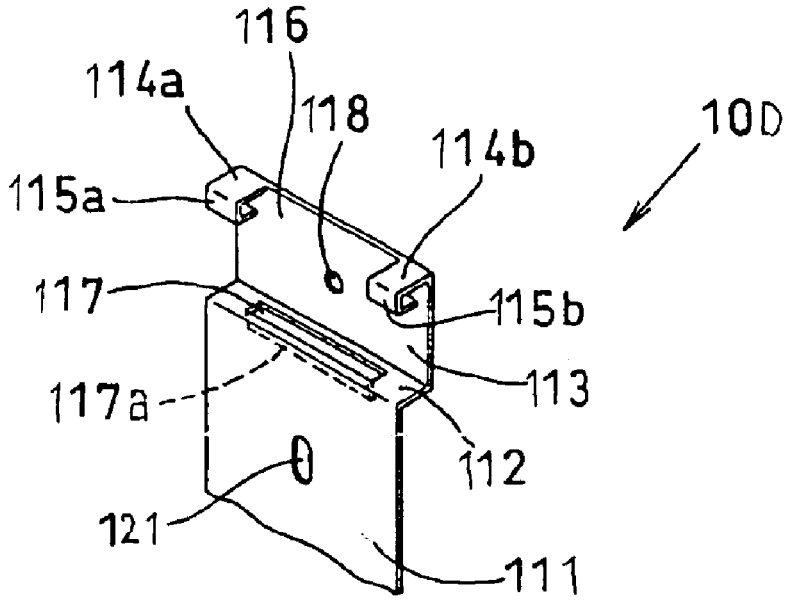
FIG. 13 is a perspective view showing a main portion of fixture according to another embodiment of the present invention.

FIG. 13 shows another embodiment of the fixture to be employed for the fastening structure of building boards according to the present invention. This fixture 10D differs from the fixture 10C shown in FIG. 9 in the respect that a wide load-bearing plate 117*a* is positioned along the forebrim of the engaging hole 117 formed in the first rising portion 112. Other constituent members are the same as those shown in FIG. 9, and hence the explanation thereof is omitted by referring them by the same numbers.

Figure 14:
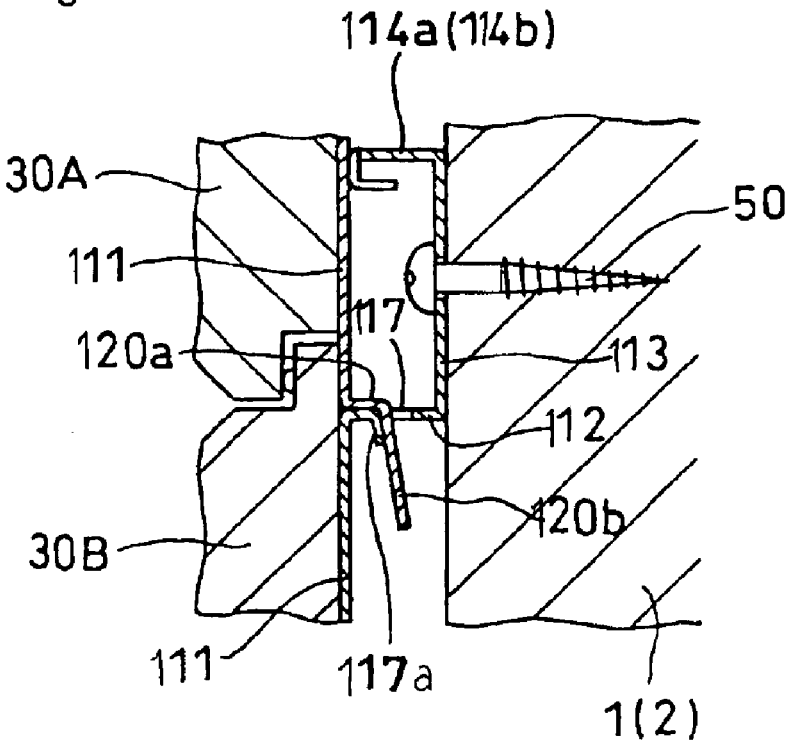
FIG. 14 is a cross-sectional view illustrating a state wherein the building board is fastened to the framework of a building by making use of the fixture of FIG. 13.

FIG. 14 shows a state wherein a couple of building boards each having the aforementioned fixture 10D fixed thereto are fastened to each other. As seen from FIG. 14, even if a surface load is imposed on the rear surface of the building board 30 that has been fastened to the framework of a building, the load can be born by the contacting surface between the oblique portion 120*b* of the engaging tongue 120 and the wide load-bearing plate 117*a* formed at the engaging hole 117, thus realizing a more stable fastened state of the building board.

Figure 15:
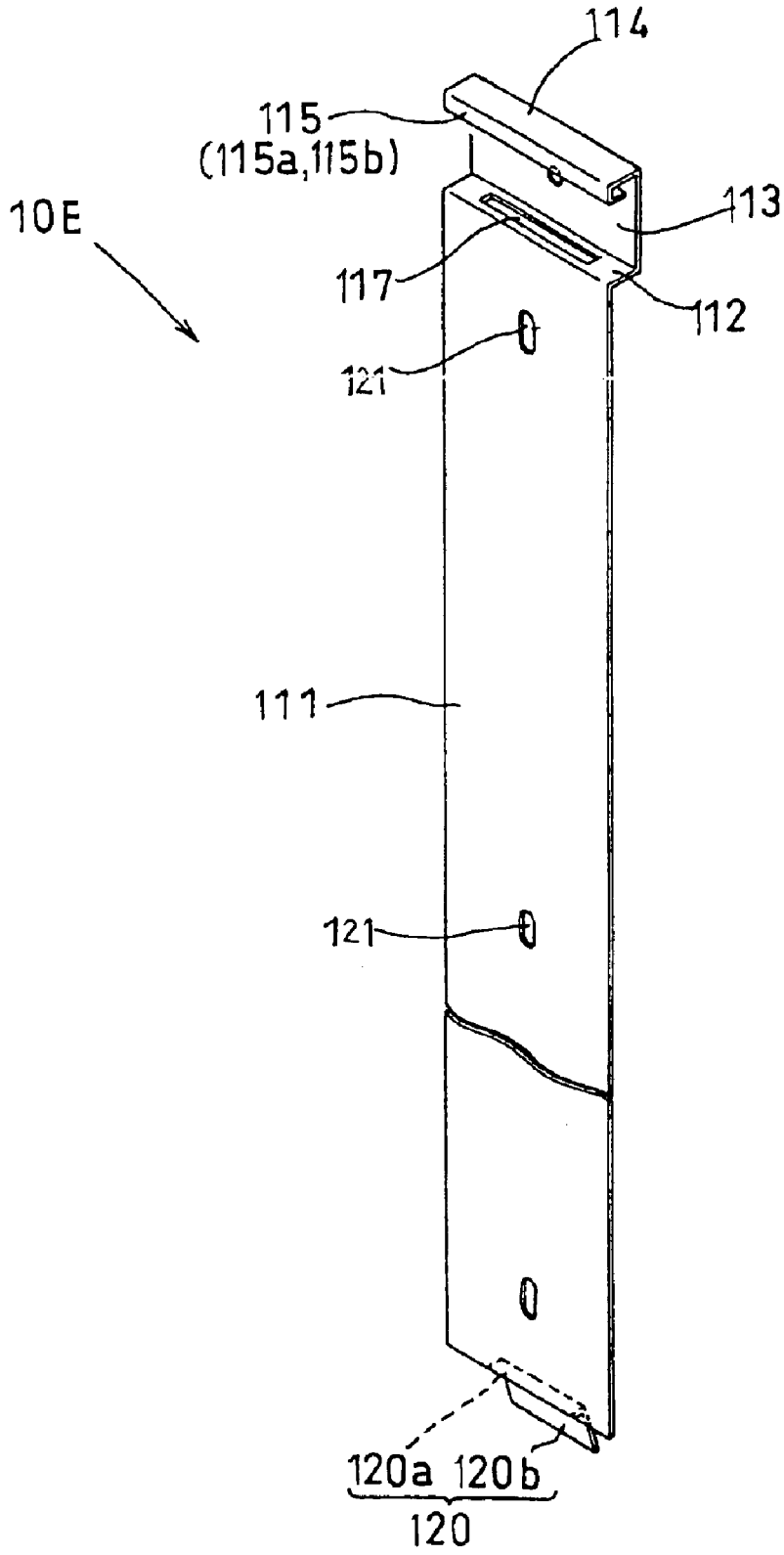
FIG. 15 is a perspective view showing a fixture according to a further embodiment of the present invention.

FIG. 15 shows a further embodiment of the fixture. While the aforementioned fixture 10C is provided with a hole 121 in place of the engaging hole 119 of the fixture 10A shown in FIG. 7, the fixture 10E shown in FIG. 15 is provided with a hole 121 in place of the engaging hole 119 of the fixture 10B shown in FIG. 8. Other constituent members are the same as those shown in FIG. 8, and hence the explanation thereof is omitted by referring them by the same numbers.

Figure 16:
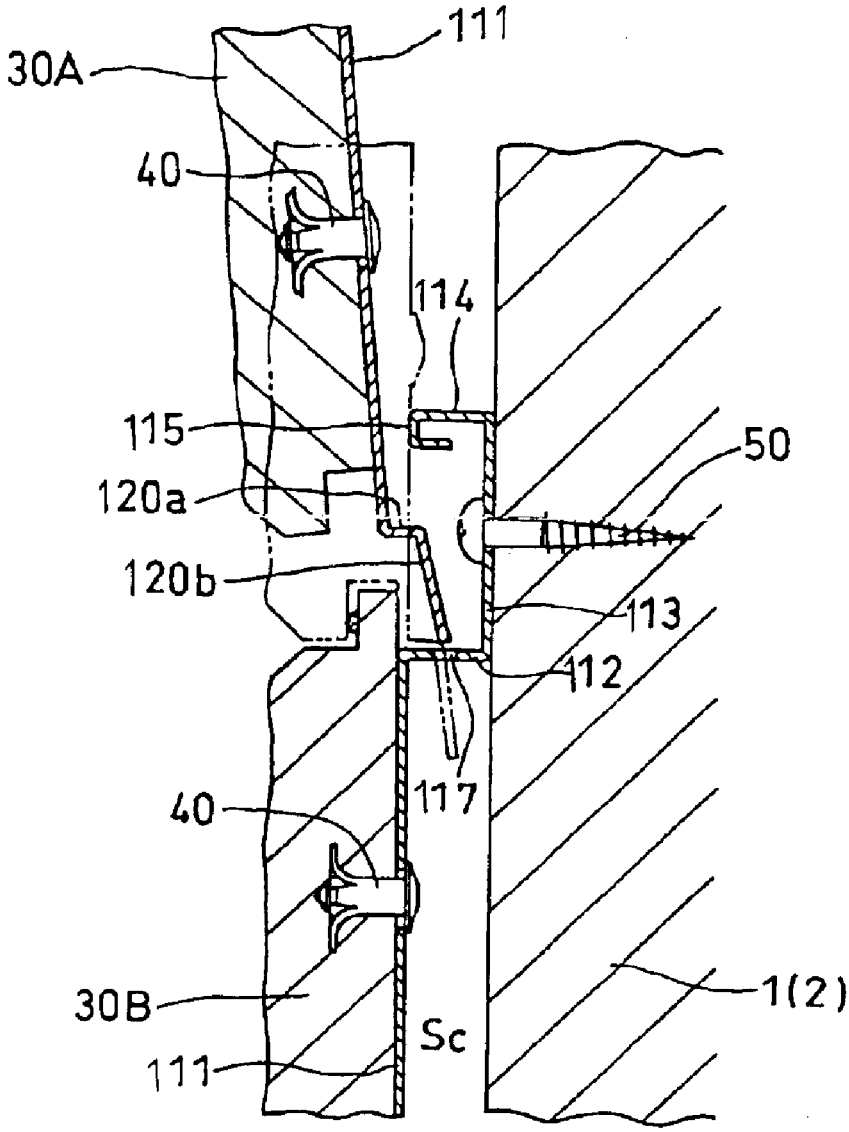
FIG. 16 is a cross-sectional view illustrating a state wherein the building board is fastened to the framework of a building by making use of the fixture of FIG. 15.
Figure 17:
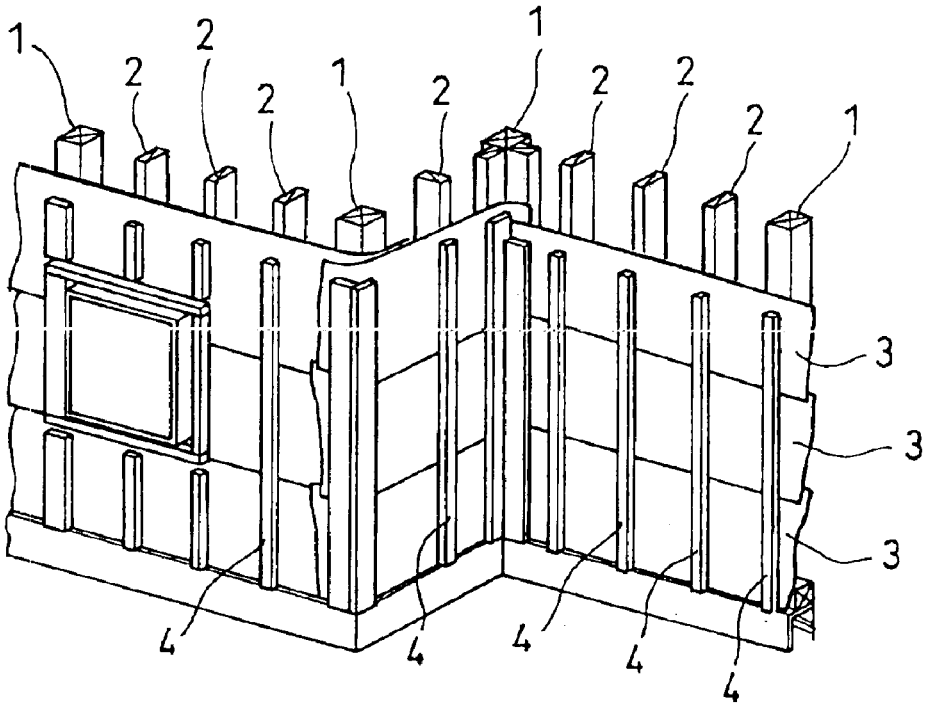
Fig. 17 PRIOR ART
FIG. 17 is a perspective view showing a horizontal siding work using siding boards.
Figure 18:
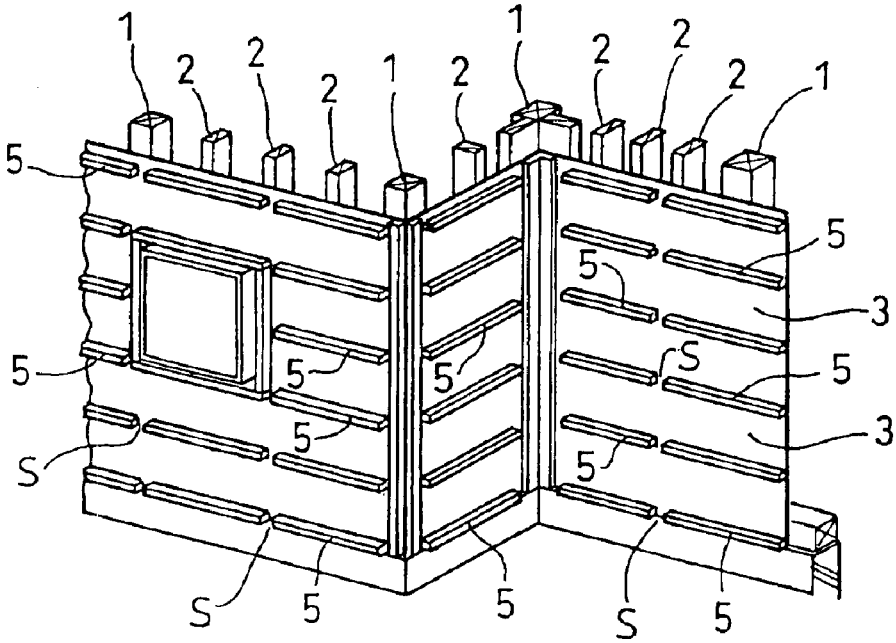
Fig. 18 PRIOR ART
FIG. 18 is a perspective view showing a vertical siding work using siding boards.
Figure 19:
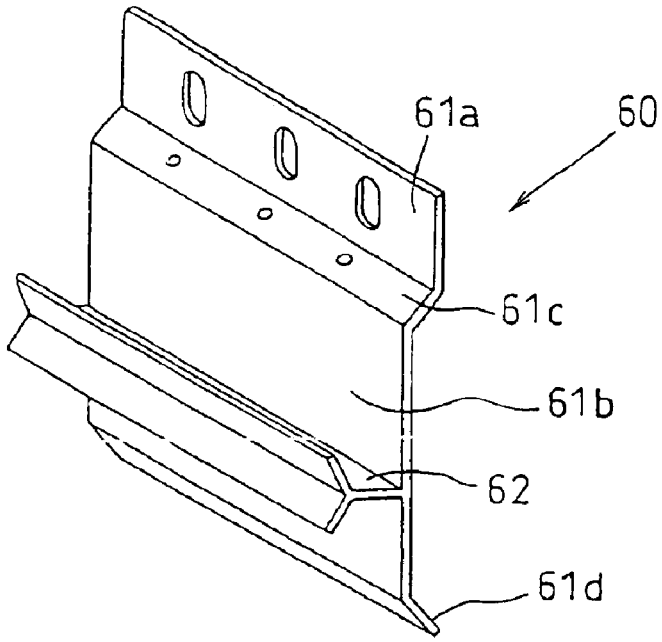
Fig. 19 PRIOR ART
FIG. 19 is a perspective view illustrating one example of a fixture of the prior art, which is employed for fastening ceramic building boards to the framework of a building.
Figure 20:
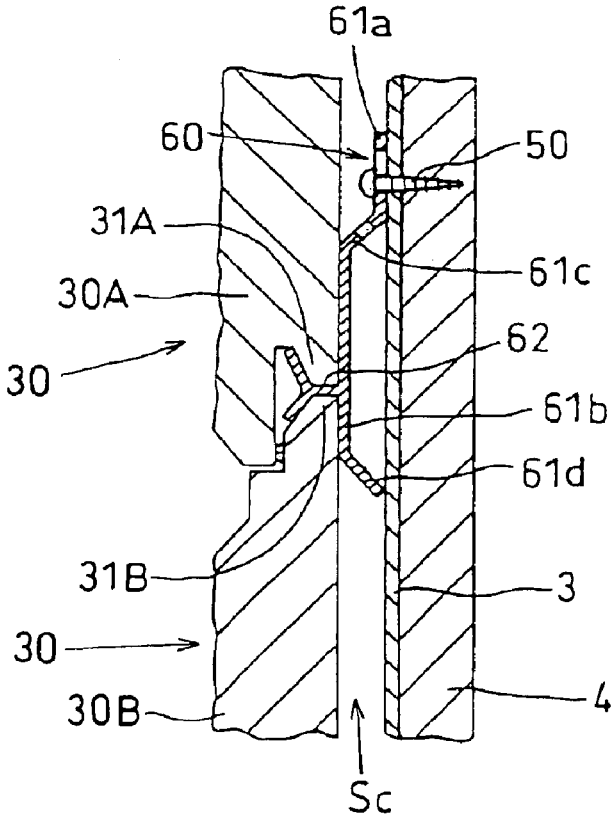
Fig. 20 PRIOR ART
FIG. 20 is a cross-sectional view illustrating a state where the ceramic building boards are fastened to the framework of a building by making use of the fixture shown in FIG. 19.

The fastening of a building board carrying the fixtures 10E on the rear surface thereof to the framework of a building can be performed in the same manner as in the case of the building board carrying the fixtures 10B on the rear surface thereof. FIG. 16 shows a cross-sectional view illustrating the manner of falling the upper building board 30A toward the lower building board 30B under the condition wherein the upper building board 30A is slightly inclined forward after the lower building board 30B has been fastened to the posts 1 or studs 2.

What is claimed is:

1. A method of fastening a building board to a framework of a building, which is characterized in that a building board having flat configuration and provided on the rear surface thereof with engaging protrusions of substantially similar shapes, and an elongated fixture which is adapted to be detachably engaged with the building board are employed, and that the building board is assembled, prior to fastening to said framework, together with the elongated fixture through an engagement between the engaging protrusions and the elongated fixture, and then the elongated fixture is fixed to the framework of a building, thereby fastening the building board to the framework of a building, wherein said fixture is constructed such that it comprises a main body which is designed to be entirely or partially contacted with the rear surface of a building board; engaging holes of substantially similar shapes formed in the main body; a rising portion formed at one end in the longitudinal direction of the main body; an engaging region formed at or near said rising portion; an extension portion extending from the distal edge of said rising portion in a direction away from and parallel with said main body; and an engaging tongue formed at the other end in the longitudinal direction of the main body; wherein said engaging tongue is positioned and shaped such that it is inserted into said engaging region of the fixture attached to a neighboring building board as a couple of building boards each having the fixture attached to the rear surface thereof are positioned neighboring in vertical direction; and comprising disposing a first building board at a lower level, fastening said first building board to the framework of a building by taking advantage of the fixture attached to the rear surface of the building board, disposing a second building board over said first building board along the upper horizontal edge of said first building board, and fastening said second building board to the framework of a building by inserting the engaging tongue of the fixture attached to the rear surface of the second building board into the engaging region formed in the fixture of the first building board.

2. A method of fastening a building board to a framework of a building by making use of a fixture; wherein said fixture is constructed such that said fixture comprises a main body which is designed to be entirely or partially contacted with the rear surface of a building board; engaging holes of substantially similar shapes formed in the main body; a rising portion formed at one end in the longitudinal direction of the main body; an engaging region formed at or near said rising portion; an extension portion extending from the distal edge of said rising portion in a direction away from and parallel with said main body; and an engaging tongue formed at the other end in the longitudinal direction of the main body; wherein said engaging tongue is positioned and shaped such that said engaging tongue is inserted into said engaging region of the fixture attached to a neighboring building board as a couple of building boards each having the fixture attached to the rear surface thereof are positioned neighboring in vertical direction; and comprising disposing a first building board at a lower level, fastening said first building board to the framework of a building by taking advantage of the fixture attached to the rear surface of the building board, disposing a second building board over said first building board along the upper horizontal edge of said first building board, and fastening said second building board to the framework of a building by inserting the engaging tongue of the fixture attached to the rear surface of the second building board into the engaging region formed in the fixture of the first building board.

3. The method of fastening a building board to a framework of a building according to claim 2, wherein said fixture is fixed to the rear surface of the building board with at least the extension portion thereof being protruded from the peripheral edge of the building board.

4. The method of fastening a building board to a framework of a building according to claim 3, wherein a plurality of said fixtures are fixed to the rear surface of said building board at predetermined intervals in conformity with the intervals of the vertical members of a building.

5. The method of fastening a building board to a framework of a building according to claim 3 or 4, wherein said fixture is fixed to the rear surface of the building board by taking advantage of a hole formed in the main body and by making use of a driving rivet whose tip opens while being driven.

6. The method of fastening a building board to a framework of a building according to claim 2, wherein said building board is a ceramic building board.

7. The method of fastening a building board to a framework of a building according to claim 2 or 6, wherein a rabbet joint-forming work is applied to at least upper and lower horizontal edges of said building board.

* * * * *